US010041632B1

(12) United States Patent
Hsieh

(10) Patent No.: US 10,041,632 B1
(45) Date of Patent: Aug. 7, 2018

(54) LIGHTING MODULE

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 15/632,032

(22) Filed: Jun. 23, 2017

(51) Int. Cl.

| | |
|---|---|
| ***F21K 9/235*** | (2016.01) |
| ***F21V 1/26*** | (2006.01) |
| ***F21V 23/00*** | (2015.01) |
| *F21Y 115/10* | (2016.01) |
| *F21K 9/20* | (2016.01) |

(52) U.S. Cl.
CPC ..... *F21K 9/235* (2016.08); *F21V 1/26* (2013.01); *F21V 23/002* (2013.01); *F21K 9/20* (2016.08); *F21Y 2115/10* (2016.08)

(58) Field of Classification Search
CPC ..... F21K 9/20; F21K 9/235; F21V 1/26
See application file for complete search history.

(56) References Cited

U.S. PATENT DOCUMENTS

2011/0157899 A1* 6/2011 Ko ..... G02B 6/0061 362/307
2014/0321112 A1* 10/2014 Huang ..... F21V 17/06 362/230

* cited by examiner

*Primary Examiner* — Thomas M Sember
(74) *Attorney, Agent, or Firm* — Hamre, Schumann, Mueller & Larson, P.C.

(57) ABSTRACT

A lighting module includes a lampshade and a base plate unit. The lampshade includes a top annular wall, and outer and inner surrounding walls extending downwardly from the top wall and spaced apart from each other. The top annular wall and the outer and inner surrounding walls cooperatively define an accommodating space. The base plate unit includes an annular base plate connected to bottom ends of the outer and inner surrounding walls, and an electrical connector connected to the annular base plate. A light plate unit is disposed in the accommodating space, and includes a light plate body disposed on the annular base plate and electrically coupled to the electrical connector, and light emitters disposed on the light plate body.

9 Claims, 8 Drawing Sheets

LIGHTING MODULE

FIELD

The disclosure relates to a lighting module, and more particularly to a lighting module with a lampshade.

BACKGROUND

For illumination, lighting devices have been widely used. Generally, a lighting device includes a lamp holder, a lighting bulb installed on the lamp holder, and a lampshade disposed around the lamp holder for converging lights from the lighting bulb. Consumers may purchase the lamp holder, the lighting bulb and the lampshade in one set, or as individuals. In case of the latter, an additional support post is needed to assemble together the lamp holder and the lampshade that are purchased from different suppliers. It may be difficult to obtain a support post that is matchable with both the lamp holder and the lampshade.

SUMMARY

Therefore, an object of the disclosure is to provide a lighting module in which a lampshade is integrated with a lamp as a unitary unit that can be directly mounted to a lamp holder.

According to the disclosure, a lighting module includes a lampshade, a base plate unit and a light plate unit.

The lampshade includes a top annular wall, an outer surrounding wall extending downwardly from an outer side of the top wall, and an inner surrounding wall extending downwardly from an inner side of the top annular wall and spaced apart from the outer surrounding wall. The top annular wall and the outer and inner surrounding walls cooperatively define an accommodating space.

The base plate unit includes an annular base plate connected to bottom ends of the outer and inner surrounding walls and covering the accommodating space, and an electrical connector connected to the annular base plate and configured to mechanically and electrically connect a lamp holder.

The light plate unit is disposed in the accommodating space. The light plate unit includes a light plate body disposed on the annular base plate and electrically coupled to the electrical connector, and a plurality of light emitters disposed on the light plate body.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
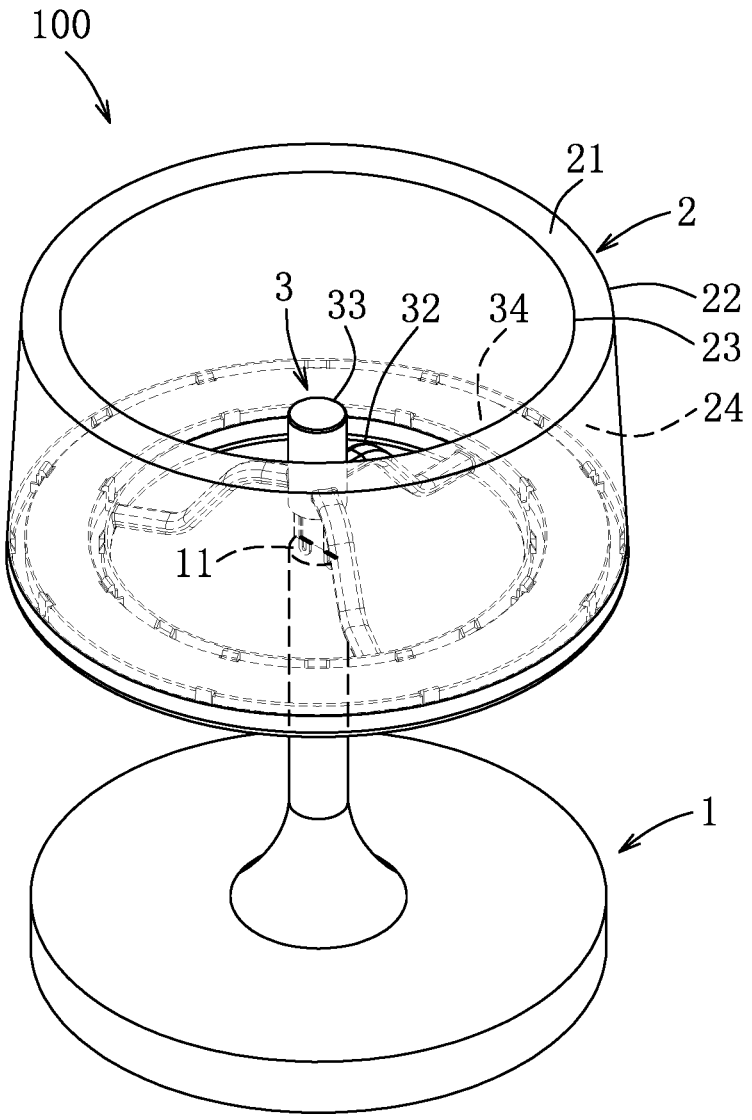
FIG. 1 illustrates a lighting module according to a first embodiment of the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
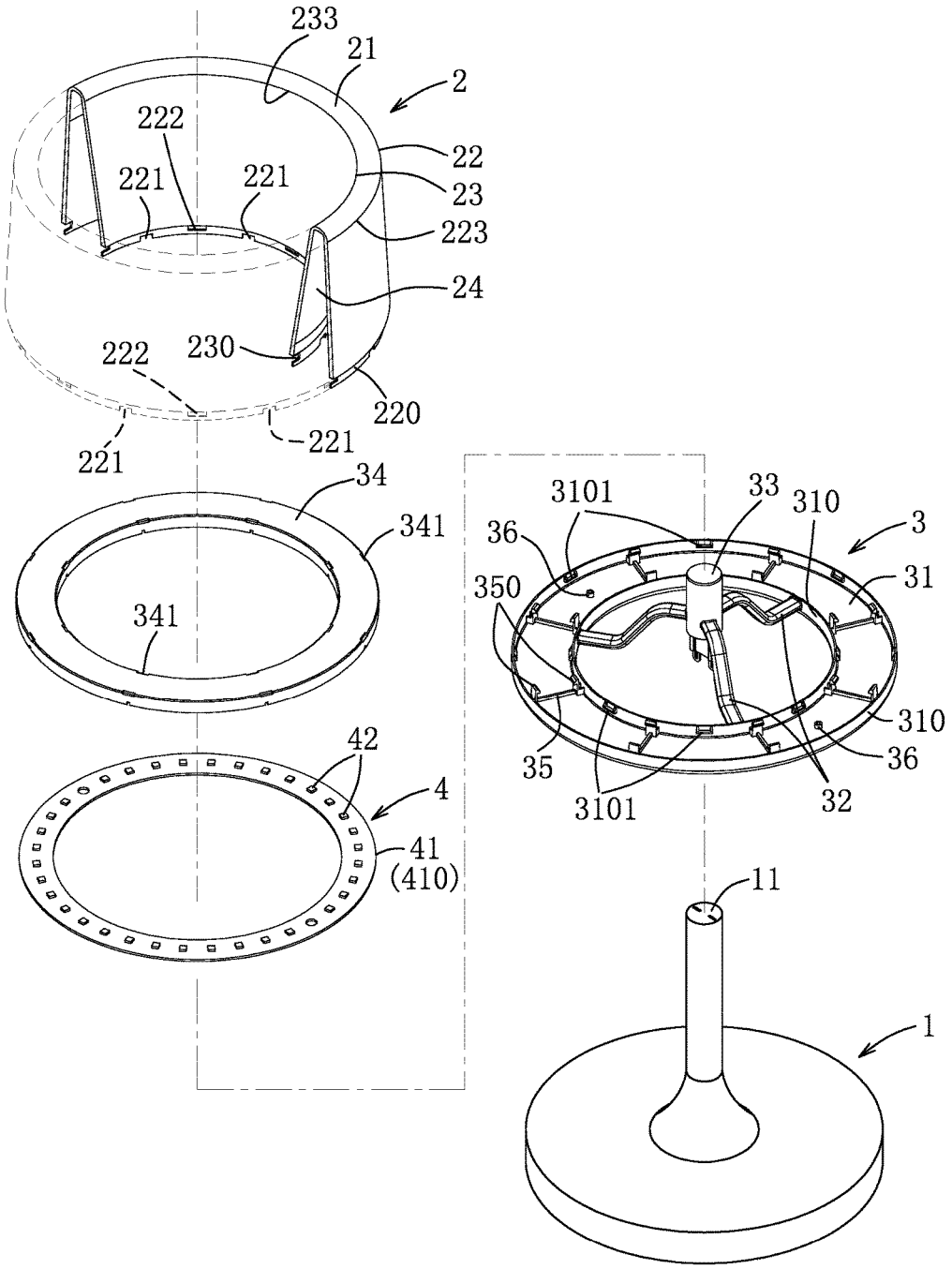
FIG. 2 is an exploded view of the first embodiment.
Figure 3:
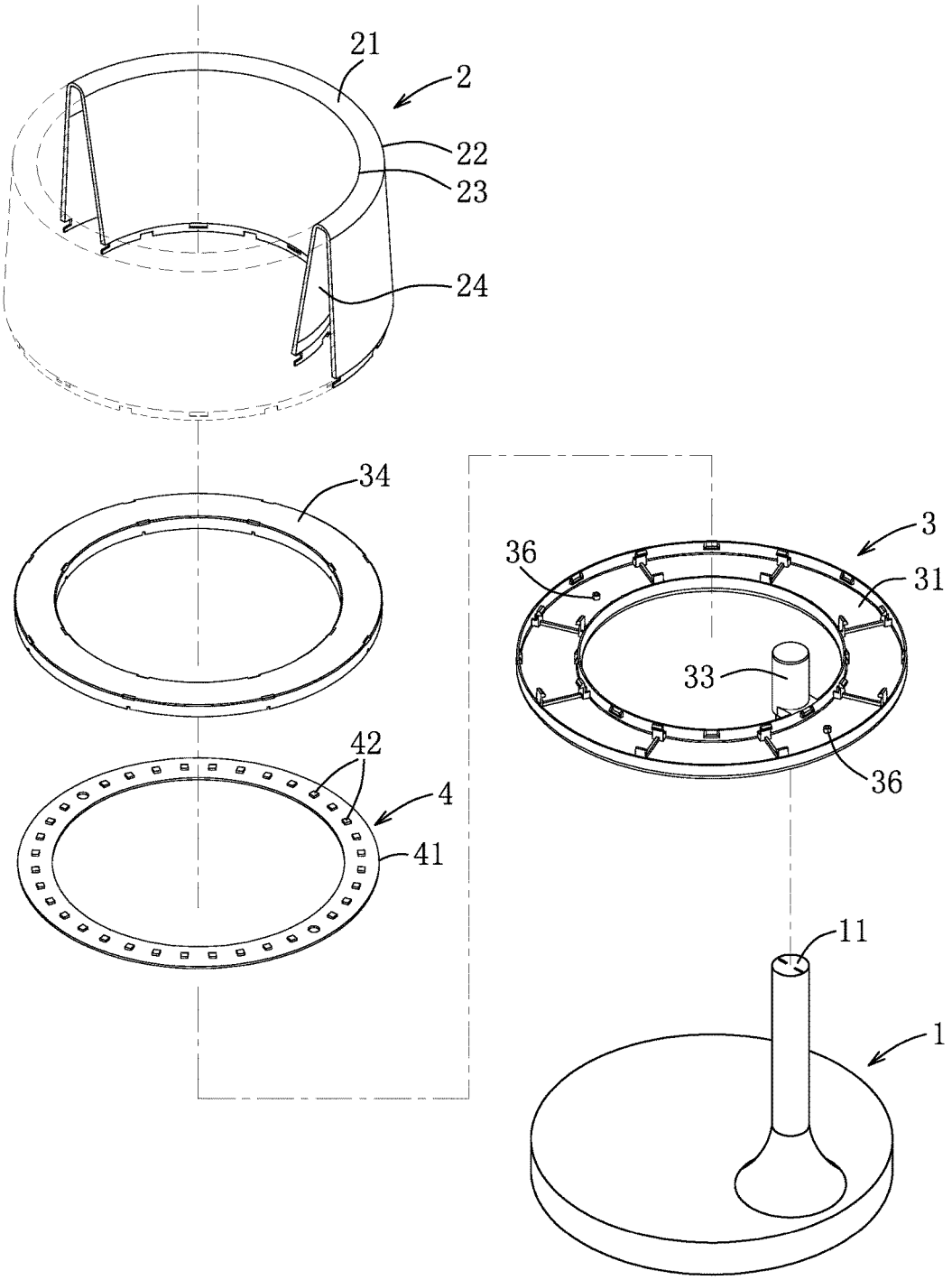
FIG. 3 is an exploded view, illustrating a lighting module according to a second embodiment of the present disclosure.

As illustrated in FIGS. 1 to 3, a lighting module 100 according to a first embodiment of the present disclosure is suitable for being mounted to a lamp holder 1 and electrically coupled to an electrical socket 11 of the lamp holder 1. The lighting module 100 includes a lampshade 2, a base plate unit 3 and a light plate unit 4.

The lampshade 2 includes a top annular wall 21, an outer surrounding wall 22 extending downwardly from an outer side of the top wall 21, and an inner surrounding wall 23 extending downwardly from an inner side of the top annular wall 21 and spaced apart from the outer surrounding wall 22. The top annular wall 21 and the outer and inner surrounding walls 22, 23 are made from a cloth or plastic material, and cooperatively define an accommodating space 24. The outer and inner surrounding walls 22, 23 diverge from the top annular wall 21 to bottom ends 220, 230 thereof. A distance between top ends 223, 233 of the outer and inner surrounding walls 22, 23 is smaller than a distance between the bottom ends 220, 230.

In addition, the bottom ends 220, 230 of the outer and inner surrounding walls 22, 23 are formed with a plurality of engaging notches 221, and a plurality of through holes 222 each of which is disposed between two adjacent ones of the engaging notches 221.

The base plate unit 3 includes an annular base plate 31, an electrical connector 33, and three support frames 32. The annular base plate 31 is disposed below the lampshade 2 to cover the accommodating space 24. In addition, the annular base plate 31 has outer and inner annular peripheries respectively formed with upward flanges 310 extending upwardly from the annular base plate 31 to respectively connect bottom ends 220, 230 of the outer and inner surrounding walls 22, 23. Two diametrically opposite tubular studs 36 are disposed on the annular base plate 31 between the outer and inner upward flanges 310 and are angularly spaced apart from each other. The outer and inner upward flanges 310 are formed with a plurality of angularly spaced-apart protrusions 3101 to respectively engage the through holes 222. A plurality of U-shaped clips 35 are disposed on the annular base plate 31. Each clip 35 has two opposite hooks 350 to respectively engage two opposite engaging notches 221.

The electrical connector 33 is surrounded by the annular base plate 31 and is configured to mechanically and electrically connect the lamp holder 1. The three support frames 32 extend inwardly from the inner upward flanges 310 and are angularly spaced apart from each other. Each support frame 32 has two opposite ends respectively connected to the inner annular periphery of the annular base plate 31 and the electrical connector 33 and is used to support the lampshade 2. In this embodiment, the electrical connector 33 is a bi-pin connector in the form of a G9-compliant connector and is disposed at a center of the lampshade 2.

The light plate unit 4 includes a light plate body 41 and a plurality of light emitters 42. The light plate body 41 is an LED printed circuit board 410 and is disposed on a top surface of the annular base plate 31 in engagement with the two tubular studs 36. The light emitters 42 are light emitting diodes and are mounted on and connected electrically to the LED printed circuit board 410. The electrical connector 33 has a wiring (not shown) that extends through one of the support frames 32 in an embedded manner so as to connect electrically with the LED printed circuit board 410. A printed circuit board connector assembly (not shown) may be used for electrical connection between the LED printed circuit board 410 and the wiring of the electrical connector 33.

In this embodiment, the base plate unit 3 further includes an annular light transparent cover 34 disposed in the accommodating space 24, clamped by the U-shaped clips 35 and covering the light plate unit 4 above the annular base plate 31. The annular light transparent cover 34 has engaging recesses 341. Each of the engaging hooks 350 of the clips 35 engages one of the engaging recesses 341 of the annular light transparent cover 34 through the respective engaging notch 221. On the other hand, the lampshade 2 and the annular light transparent cover 34 are light transmissible and can absorb partial lights of the light emitters 42. Therefore, the light produced by the lighting module 100 is gentle to reduce the risk of harm to the user's eyes.

In this embodiment, the top annular wall 21, the annular base plate 31, the annular light transparent cover 34 and the light plate body 41 are circular. The annular base plate unit 3 not only supports the lampshade 2 and the light plate unit 4 but also is integrated therewith to form the lighting module 100 that can be directly mounted to the lamp holder 1, which may be one of existing lamp holders. When the electrical connector 33 is electrically coupled to the electrical socket 11 of the lamp holder 1, the lighting module 100 is supported on the lamp holder 1. Assembly in such a manner is simple and easy. It is unnecessary for a user to purchase additional accessory for assembly with the lighting module 100.

FIG. 3 illustrates a lighting module according to a second embodiment of the present disclosure, which is generally similar to the first embodiment. The differences of the second embodiment reside in that the electrical connector 33 is directly connected to the annular base plate 31 and is close to the inner surrounding wall 23 of the lampshade 2. The support frames 32 are dispensed with.

Figure 4:
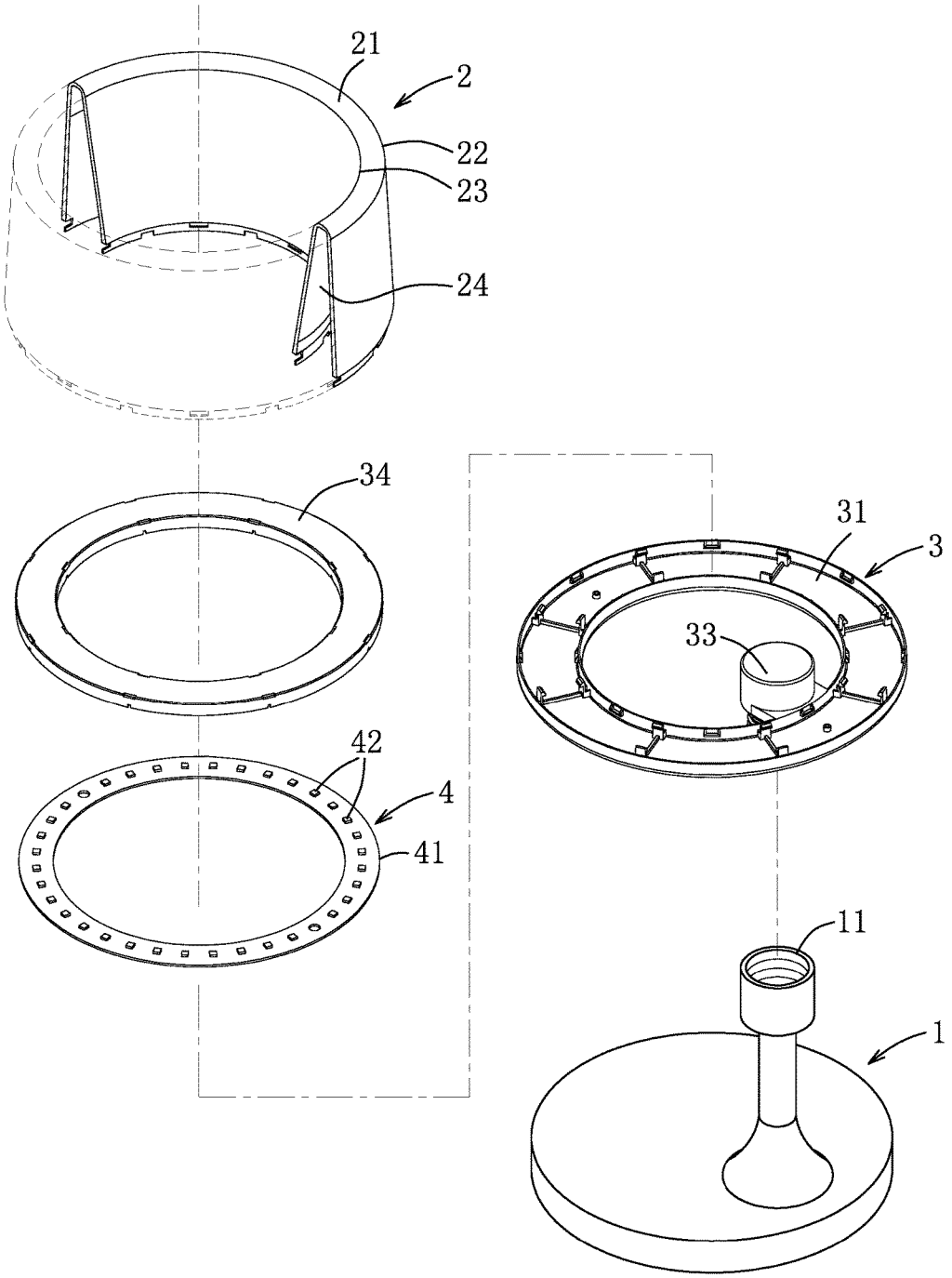
FIG. 4 is an exploded view, illustrating a lighting module according to a third embodiment of the present disclosure.
Figure 5:
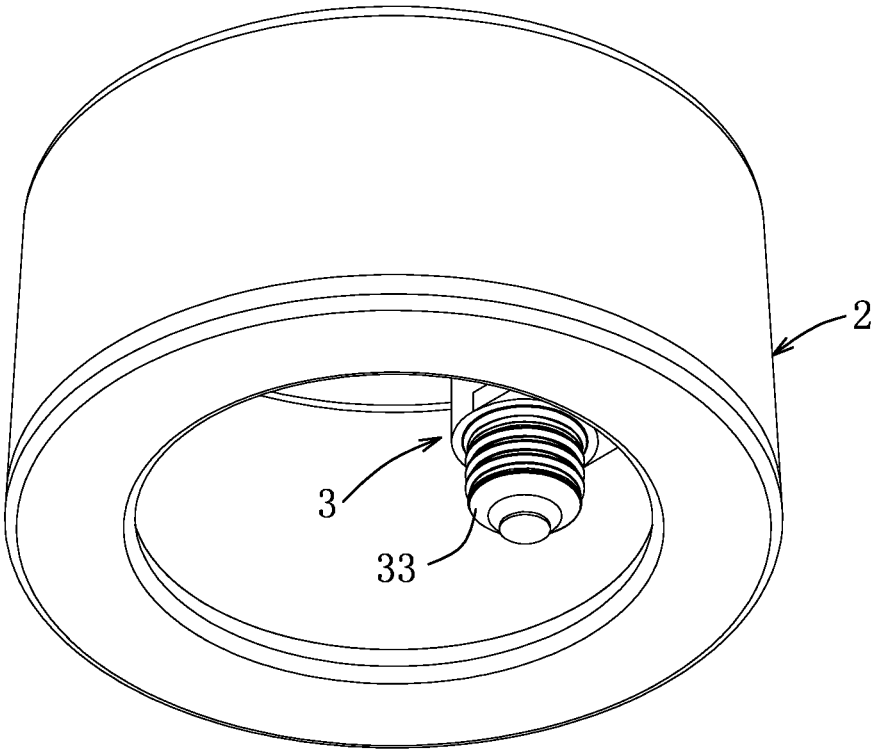
FIG. 5 is a perspective view, illustrating the lighting module of the third embodiment.

FIGS. 4 and 5 illustrate a lighting module according to a third embodiment of the present disclosure, which is generally similar to the second embodiment. However, in the third embodiment, the electrical connector 33 is a screw-in connector, such as an E26 or E27 Edison-screw connector, and the electrical socket 11 of the lamp holder 1 is an E26 or E27 Edison socket.

Figure 6:
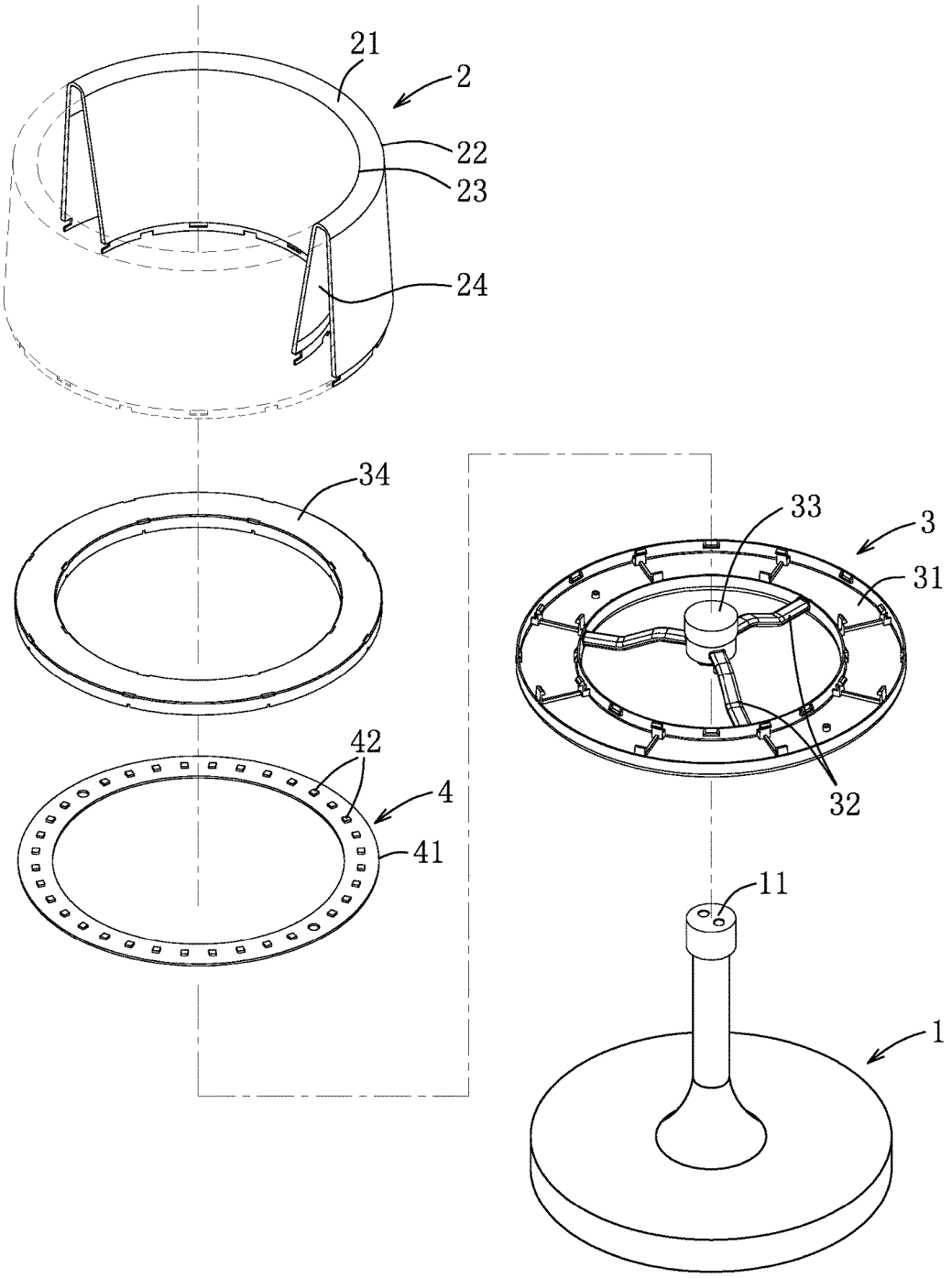
FIG. 6 is an exploded view, illustrating a lighting module according to a fourth embodiment of the present disclosure.
Figure 7:
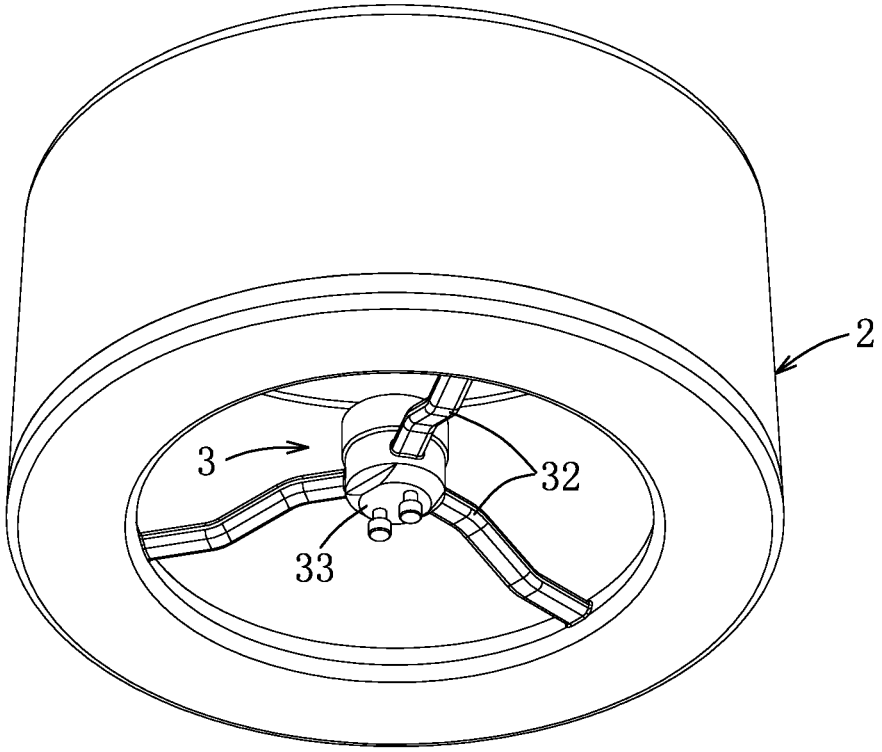
FIG. 7 is a perspective view, illustrating the lighting module of the fourth embodiment.

FIGS. 6 and 7 illustrate a lighting module of a fourth embodiment according to the present disclosure, which is generally similar to the first embodiment. However, in the fourth embodiment, the electrical connector 33 is a GU-10 connector, and the electrical socket 11 of the support post 1 is a G-10 socket.

Figure 8:
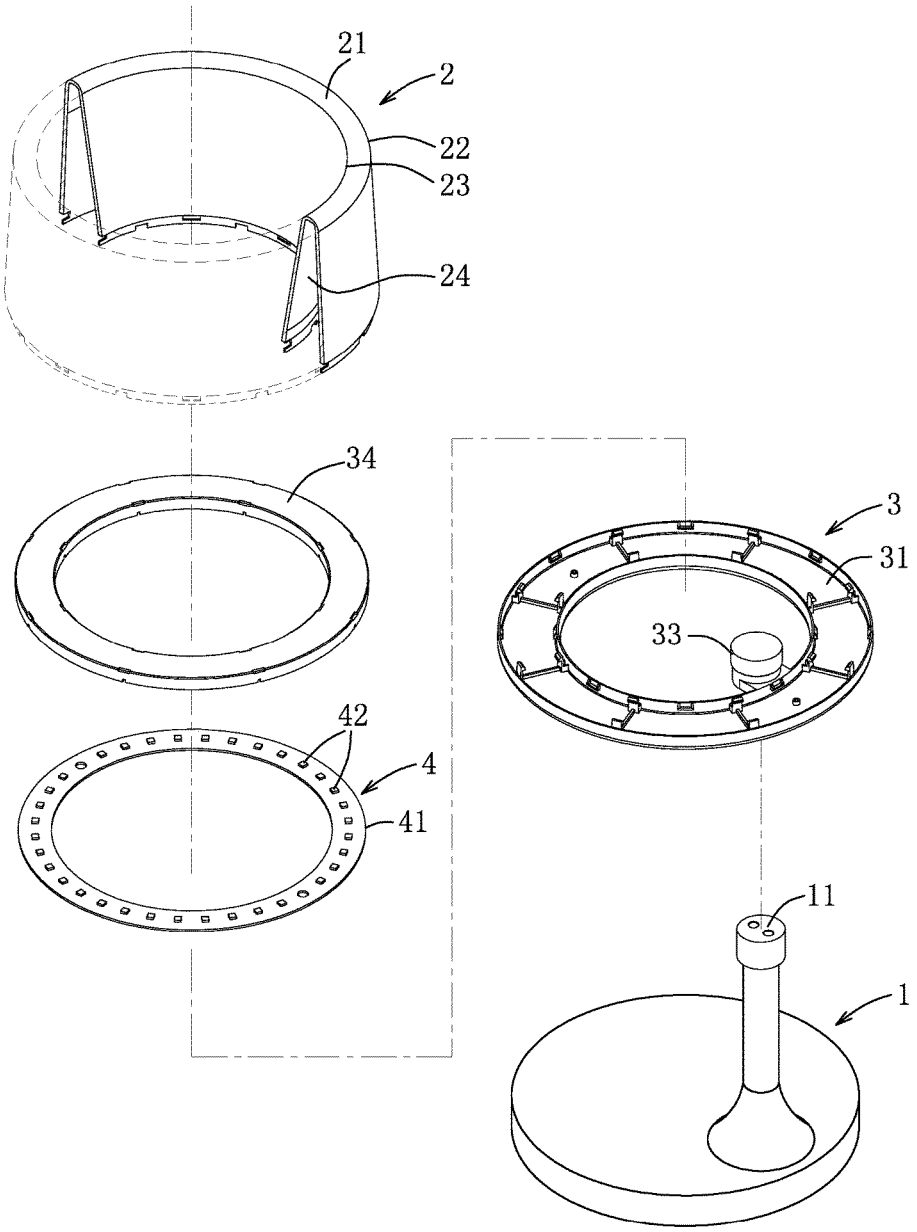
FIG. 8 is an exploded view, illustrating a fifth embodiment of a lighting module according the present disclosure.

Referring to FIG. 8, a lighting module of the fifth embodiment differs from the fourth embodiment in that the electrical connector 33 is directly connected to the annular base plate 31.

To sum up, aside from being able to support the lampshade 2 and the light plate unit 4, the annular base plate unit 3 can integrate the lampshade 2 with the light plate unit 4 to form the lighting module 100 that can be directly mounted to an existing lamp holder. Assembly of the lighting module 100 is simple and easy. The electrical connector 33 may be any kind of connector and is therefore compatible with the electrical connector of any existing lamp holder. The lighting module 100 of the present disclosure is connectable not only to the lamp holder 1 that may be placed on a desk or table, but also to a lamp holder mountable on a ceiling or a wall.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A lighting module, comprising:

a lampshade including a top annular wall, an outer surrounding wall extending downwardly from an outer side of said top wall, and an inner surrounding wall extending downwardly from an inner side of said top annular wall and spaced apart from said outer surrounding wall, said top annular wall and said outer and inner surrounding walls cooperatively defining an accommodating space;

a base plate unit including an annular base plate connected to bottom ends of said outer and inner surrounding walls and covering said accommodating space, and an electrical connector connected to said annular base plate and configured to mechanically and electrically connect a lamp holder; and a light plate unit disposed in said accommodating space, said light plate unit including a light plate body disposed on said annular base plate and electrically coupled to said electrical connector, and a plurality of light emitters disposed on said light plate body.

2. The lighting module as claimed in claim 1, wherein said annular base plate has outer and inner annular peripheries respectively connected to said bottom ends of said outer and inner surrounding wall, said light plate body being an annular printed circuit board.

3. The lighting module as claimed in claim 2, wherein said electrical connector is surrounded by said annular base plate, said base plate unit further includes a plurality of support frames each having two opposite ends respectively connected to said inner annular periphery of said annular base plate and said electrical connector.

4. The lighting module as claimed in claim 3, wherein said electrical connector is disposed at a center of said lampshade.

5. The lighting module as claimed in claim 2, wherein said electrical connector is connected directly to said inner annular periphery of said annular base plate.

6. The lighting module as claimed in claim 1, wherein said base plate unit further includes an annular light transparent cover disposed in said accommodating space and covering said light plate unit above said annular base plate.

7. The lighting module as claimed in claim 6, wherein said top annular wall, said annular base plate, said annular light transparent cover and said light plate body are circular.

8. The lighting module as claimed in claim 1, wherein said electrical connector is one of a screw-in connector or a bi-pin connector.

9. The lighting module as claimed in claim 1, wherein said outer and inner surrounding walls diverge from said top annular wall to said bottom ends thereof.

* * * * *